US007134157B2

(12) United States Patent
Koch

(10) Patent No.: US 7,134,157 B2
(45) Date of Patent: Nov. 14, 2006

(54) MOTOR-ADJUSTABLE HEAD REST

(75) Inventor: Guido Koch, Karlsruhe (DE)

(73) Assignee: Maquet GmbH & Co, KG, Rastatt (DE)

( * ) Notice: Subject to any disclaimer, the term of this patent is extended or adjusted under 35 U.S.C. 154(b) by 0 days.

(21) Appl. No.: 10/535,367

(22) PCT Filed: Nov. 11, 2003

(86) PCT No.: PCT/EP03/12588

§ 371 (c)(1),
(2), (4) Date: Oct. 18, 2005

(87) PCT Pub. No.: WO2004/045483

PCT Pub. Date: Jun. 3, 2004

(65) Prior Publication Data

US 2006/0150334 A1 Jul. 13, 2006

(30) Foreign Application Priority Data

Nov. 19, 2002 (DE) ..... 102 53 863

(51) Int. Cl.
*A61G 13/12* (2006.01)
*A47C 20/00* (2006.01)

(52) U.S. Cl. ..... 5/622; 5/621; 5/640

(58) Field of Classification Search ..... 5/622, 5/621, 640, 636, 623, 624, 646, 648, 503.1, 5/658, 661; 297/391, 408, 409
See application file for complete search history.

(56) References Cited

U.S. PATENT DOCUMENTS 4,515,406 A * 5/1985 Fujiyama et al. ..... 297/409
4,840,429 A * 6/1989 Stockl ..... 297/409
6,467,846 B1 * 10/2002 Clough ..... 297/410
6,607,242 B1 * 8/2003 Estrada et al. ..... 297/216.12
6,666,517 B1 * 12/2003 Clough ..... 297/410
7,040,705 B1 * 5/2006 Clough ..... 297/410
2004/0195893 A1 * 10/2004 Clough ..... 297/391
2004/0217639 A1 * 11/2004 Clough ..... 297/391

FOREIGN PATENT DOCUMENTS

DE 9116002.2 U1 * 2/1992

* cited by examiner

*Primary Examiner*—Robert G. Santos
(74) *Attorney, Agent, or Firm*—McDonnell Boehnen Hulbert & Berghoff LLP

(57) ABSTRACT

A motor-adjustable head rest for operating tables comprises a head plate (12) which is arranged at one end of a curved support shaft (24) which, in a plane which is perpendicular with respect to the axis of curvature, is guided in an adjustable manner on a support between three rollers (26, 28, 30) which are spaced from one another in the direction of adjustment, which support can be connected to the operating table. The tracks (32, 34, 36) for the rollers (26, 28, 30) which are formed on the support shaft (24) are shaped such that their instantaneous curvature centers in each position of the support shaft (24) coincide with the instantaneous center of rotation of the head movement during the lifting and the lowering of the patient's head (14) resting on the head plate (12).

9 Claims, 6 Drawing Sheets

MOTOR-ADJUSTABLE HEAD REST

The invention relates to a motor-adjustable head rest for operating tables, comprising a head plate which is arranged at one end of a curved support shaft which, in a plane which is perpendicular with respect to the axis of curvature, is guided in an adjustable manner on a support between three rollers which are spaced from one another in the direction of adjustment, which support can be connected to the operating table.

Existing head rest systems can be divided into head rests whose position can be manually adjusted and head rests with assistance for the lifting motion by extraneous energy, such as an electromotor or a hydraulic drive. Particularly simple versions only comprise a sequential arrangement of several elements which can be rotated with respect to each other and which are braced against one another once the correct position has been found. In these simple systems, the load of the head plate has to be borne by the operator during the adjustment procedure, which requires the use of both hands. Such an arrangement is not suitable for intraoperative adjustments.

Manual systems, which also allow an adjustment of the head plate during the operation, continuously support the load. The vertical lifting in these cases is started by a mechanical drive which, on the one hand, ensures small adjustment forces and, on the other hand, the design of which on the load side is self-locking to prevent an undesired lowering of the head. Additional degrees of freedom of the head plate such as lateral (horizontal) shifts or lateral pivoting movements can be blocked by simple clamp connections since their adjustment requires almost no power.

As already mentioned, the vertical lifting can also be achieved using extraneous energy. Depending on the chosen system, the self-locking can also be omitted so that the load of the weight is directly applied on the actuators.

In most known head rest systems, the path of the lifting movement can be reduced to the following forms:

Parallelogram Guidance:

The head is placed on a cross bar which is connected by two parallel control levers to the fixation points in the area of the patient's back. As a result, the head describes a purely translational path corresponding to a circular arc.

Rotational Guidance:

The head is supported on a cross bar that is rotatably mounted at a point under the patient and thus describes a circular path when the same is adjusted. The length of the cross bar should be as long as possible in order to have an almost linear lifting motion of the head.

Haslinger Head Rest:

The Haslinger head rest corresponds to the head rest described in the introduction. To achieve a nearly anatomically correct adjustment movement of the head, the support shaft is formed by a segment of a circular ring, which is guided through three support rollers and which is driven via a tooth system on the segment of the circular ring. This guidance allows the shifting of the center of the rotational movement of the head to the area above the patient support surface.

All the known head rest systems have in common that the adjustment motion is carried out by very simple forms of movement which, taking mechanical boundary conditions into account, describe nearly linear or circular paths. These paths, however, do not correspond to human anatomy so that compensatory movements of the head must occur. If this compensatory movement is prevented, for example due to the positioning of the head in a head cap, then the patient is subject to compression or stretching depending on the direction of adjustment. If the patient is awake, he or she will briefly raise the head when the pain comes up and thus produce a compensation. However, a relaxed patient does not have this possibility and remains in the given tensioned position.

The invention is based on the problem of developing a motor-adjustable head rest of the type mentioned in the introduction such that the head of a patient who is lying on the patient support surface of the operating table can follow an anatomically correct path during the lifting and the lowering of the head plate.

According to the invention, this problem is solved by shaping the tracks formed on the support shaft and used for the rollers such that their instantaneous centers of curvature in each position of the support shaft coincide with the instantaneous centre of rotation of the head movement during the lifting and the lowering of the patient's head which rests on the head plate.

The inventive solution is based on an analysis of the anatomically correct movement of the head and on the recognition that the vertebral column which connects the head to the body, can be considered to be a link chain in the technical implementation of the head rest system. Thus, the vertebral column corresponds to the sequential arrangement of individual elements which are rotatably connected to each other at appropriate intervals and each of which elements allows a certain amount of torsion, and the resistance acting against the torsion increases with increasing angle of torsion.

The extended and straight position is considered the middle position and starting position in the following considerations. In the middle position, all the elements of the influenced area are arranged in a straight line. If the head is now lifted out of this position, this will first result in a rotational movement in the rotating element which is farthest from the head since there the force is applied with the greatest lever arm and causes the least torsion. However, with increasing rotation, the tension in this rotating element becomes greater than that of the adjacent rotating element closer to the head so that the latter element now experiences a torsion. Thus, the center of the rotational movement, as the head is lifted higher, moves from the point at the greatest distance in the direction toward the head. The curve, which is described by the chain of elements, corresponds to a spiral which, starting in the horizontal direction gradually curves upward with decreasing radius. For the movement of the head this means that, starting out from a vertical lifting movement from the middle position, the head ideally follows a spiral with increasing curvature, whose instantaneous poles or centers migrate on the described center spiral from the point at the greatest distance at the beginning of the lifting movement in the direction of the head.

As the head is lowered from the middle position downward, the same rules apply. The patient support surface however restricts the number of elements participating in the movement to a high extent so that a spiral with a clearly narrower radius of curvature is produced. The last point of rotation here is located at the vertebral insertion point at the base of the skull.

The continuous movement of the point of rotation on the center spiral can also be represented as discrete rotations about defined points of rotation, to simplify the technical solution, the points of rotation being located on the center spiral. The path of the head is then represented by a sequential arrangement of circular arcs, which are in tangential contact to achieve a continuous movement and whose radii of curvature become increasingly smaller from the middle position toward the final position.

If two points of a body are fixed during a planar movement, then each additional point of the body is thus fixed in its position. In the same manner, the curve path of a point of a body, in this case the center of gravity of the head, can be described by the curve paths of at least two other points of the body. As a result, a movement curve of the head can be represented by a guide element which is applied to the head, and which is guided at at least two points on different position-specifically curve functions. In the solution according to the invention, this principle is now implemented in that the support shaft is clamped between three rollers, whose tracks which are formed on the support shaft also have a different shape because of the different positions of the rollers. The shapes of the tracks are derived from the desired movement of the head. In this process, at each point, the movement of rotation of the head about a point of rotation on the above-described center spiral is described by a rolling motion of the rollers on the tracks, whose corresponding instantaneous pole or curvature center coincides with this point of rotation of the head. If at least two points of the supporting support shaft are guided on concentric circular paths (achieved by the respective tracks with the associated rollers), then all the points, which are rigidly connected to the support shaft and thus also to the head of the patient, move on sections of a circular path about the same center of rotation. The third roller prevents a lifting of the support shaft from the two mentioned rollers in the case of a change in the direction of load application and it is preferably prestressed in the direction toward the support shaft to compensate for production inaccuracies.

In a preferred embodiment the support is designed in the form of a housing which can be rigidly connected to the operating table, the rollers being mounted in the housing and the support shaft being guided therein.

The drive of the support shaft can be implemented in different manners. For example, the support shaft can carry a gear track into which a pinion which can be driven by a motor engages. In a preferred embodiment, the gear track is provided on a side surface of the support shaft that is perpendicular to the axis of curvature of the support shaft, the drive device comprising the motor and the pinion being mounted in the support in a manner movably about an axis which can be pivoted toward the side surface.

In a further embodiment, the drive device comprises a threaded spindle which can be rotated by a motor, which is supported on the support and which engages into a nut which is movably mounted on the support shaft.

In a further embodiment the drive device comprises a pulling element which is attached to or near the two ends of the support shaft, and which is guided over a driving wheel which can be driven by a motor. This pulling element can be a chain or a toothed belt so that a slip-free adjustment of the support shaft is made possible.

Finally, the drive device could also be formed by a hydraulic cylinder, which is applied at the support shaft and is supported on a support which is firmly attached to the table. This embodiment is particularly suitable for a head rest which is permanently connected to a hydraulically adjustable operating table.

Further features and advantages of the invention will become apparent from the following description which in connection with the attached drawings explains the invention on the basis of an embodiment.

FIGS. 1*a–c* are schematic representations of the movement of the head of a person who is lying on his/her back.

Figure 1A:
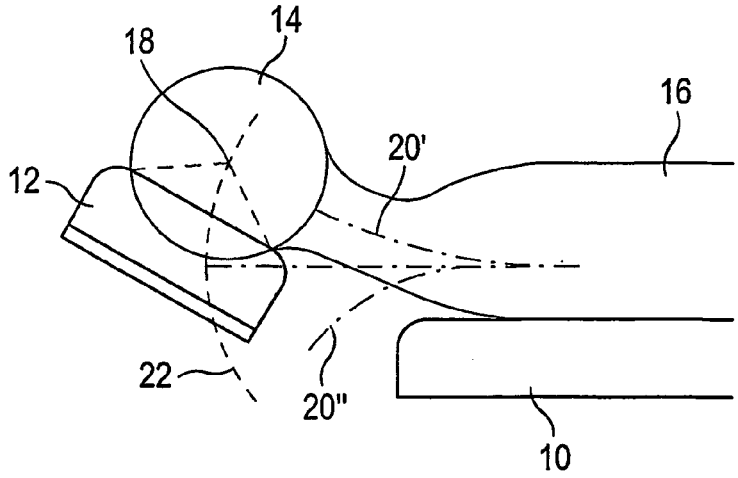
Figure 1B:
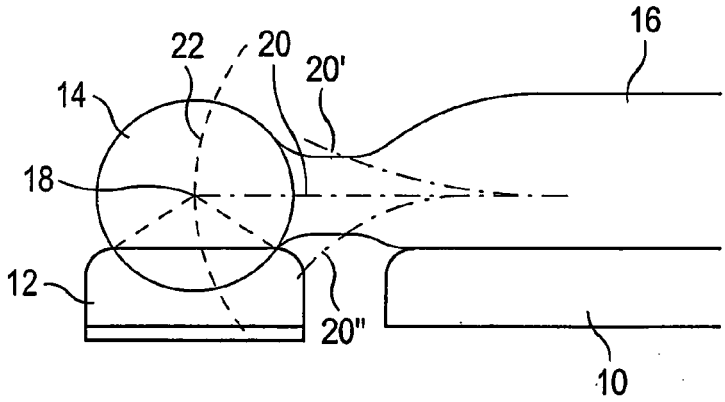
Figure 1C:
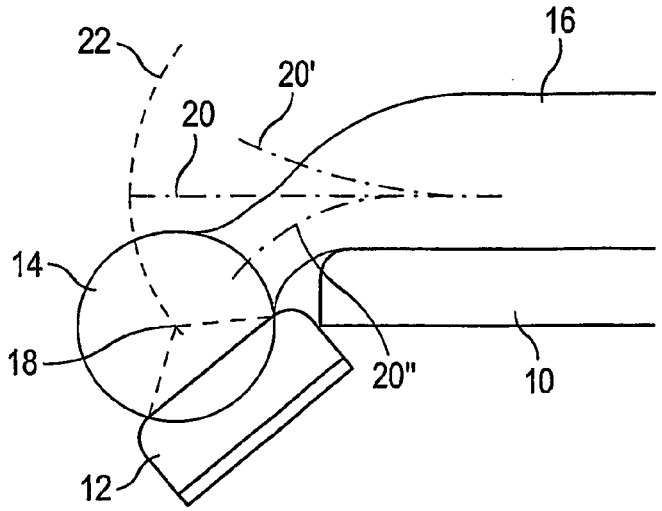

FIGS. 1*a–c* show the curvature of the vertebral column during the up and down movements of the head of a patient who lies on the back. The reference numeral 10 denotes the patient support surface of an operating table, on which a head plate 12 is arranged in an adjustable manner. On the head plate 12, the head 14 of a patient 16 who lies on the patient support surface 10 rests. The reference numeral 18 denotes the center of gravity of the head.

FIG. 1*b* shows the patient 16 in the stretched position, the head plate 12 being in alignment with the patient support surface 10, and the vertebral column 20 of the patient forming a straight line. If the head 14 of the patient is lifted by means of the head plate 12, then the vertebral column curves along the path 20' in FIG. 1*a*. If the head 14 is moved downward by lowering the head plate 12, then the vertebral column follows the path 20" in FIG. 1*c*. One can see that the vertebral column does not perform a pivoting movement about a fixed center of rotation and that the paths 20' and 20" present different curvatures.

Figure 2:
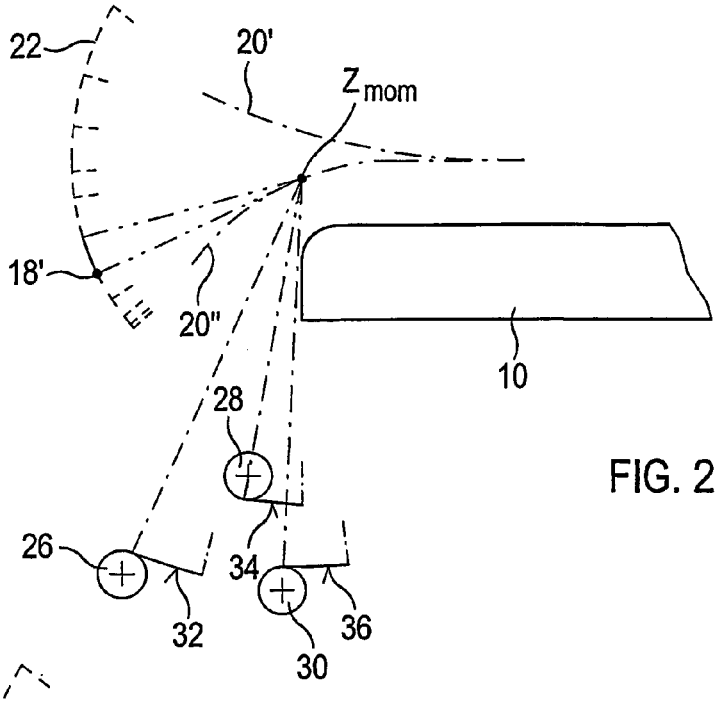
FIG. 2 is a graphic representation to explain the technical implementation of the path curve for the adjusting movement of the head plate.
Figure 3:
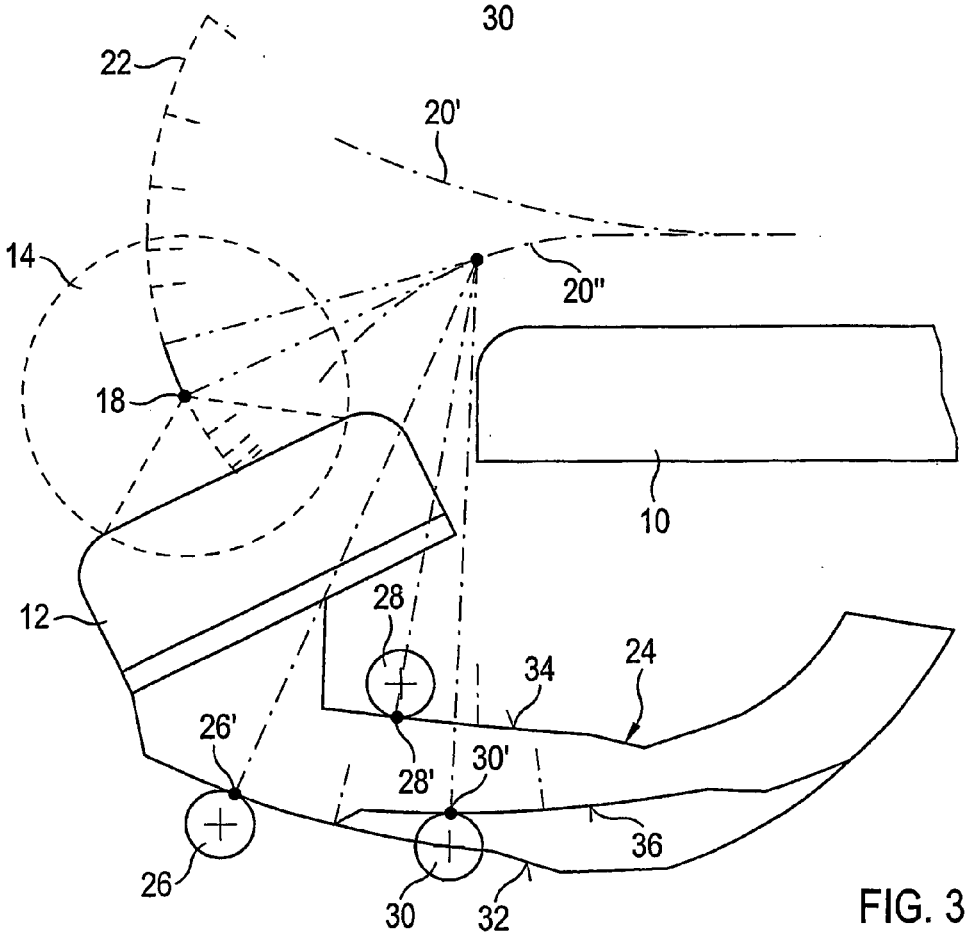
FIG. 3 is a schematic representation of the overall concept for the path curve of the head and the guidance of the head rest.
Figure 4:
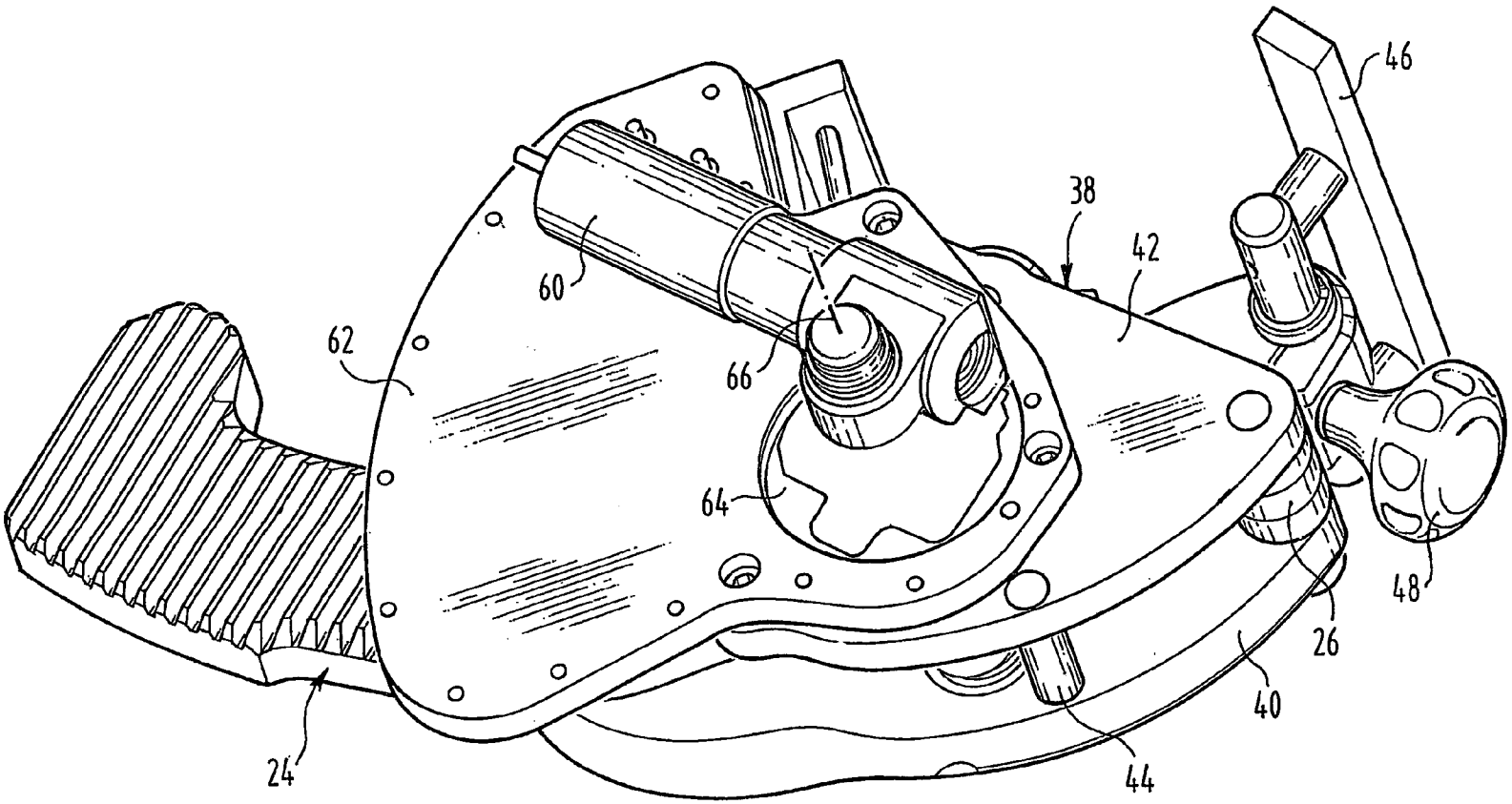
FIG. 4 is a perspective overview of the motor-adjustable head rest according to the invention.
Figure 5:
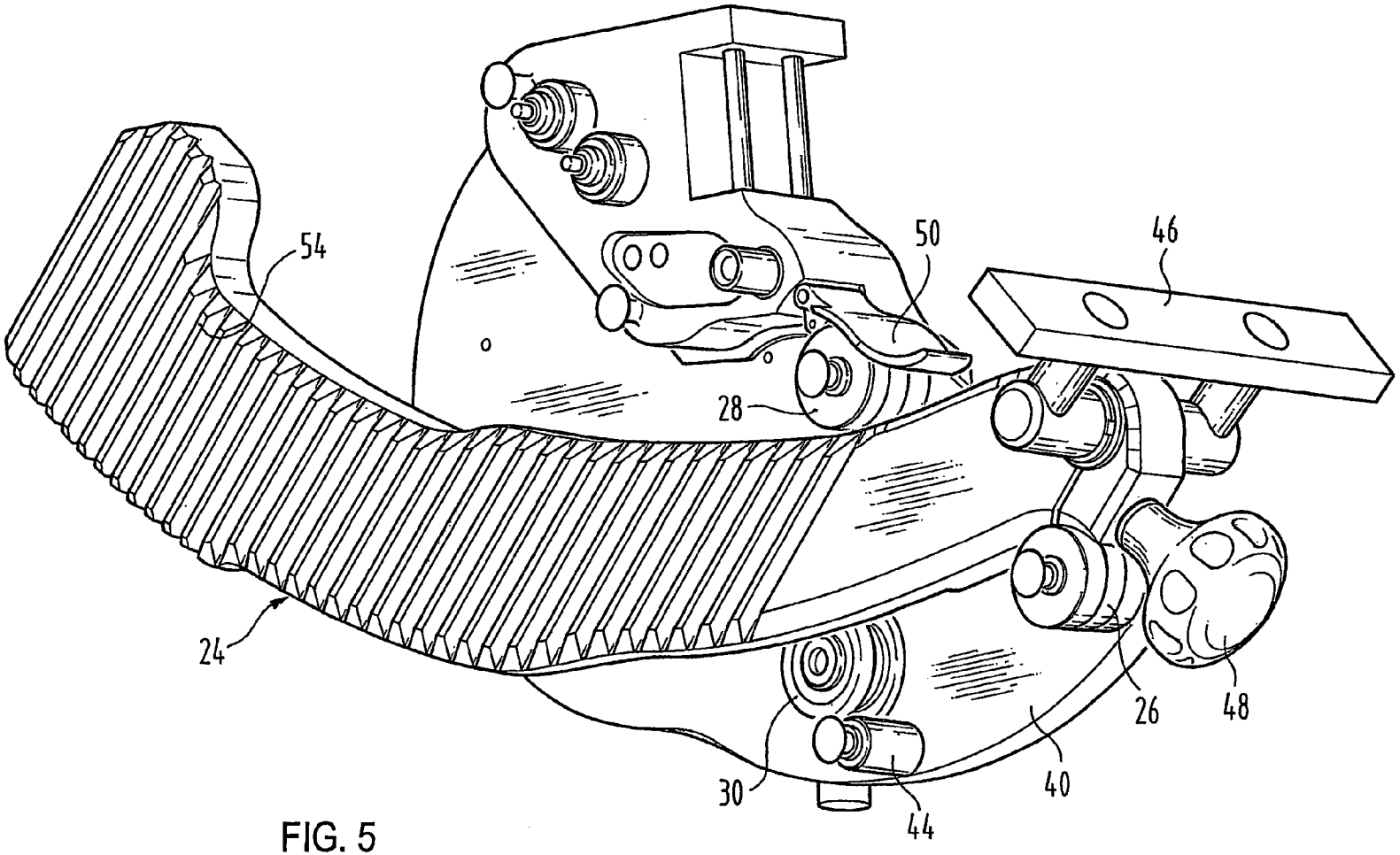
FIG. 5 is a representation of the head rest which approximately corresponds to that of FIG. 4, a portion of the housing being removed.

With reference to FIGS. 2 and 3 it is to be explained how the head plate 12 can be adjusted in such a manner that the center of gravity 18 of the head 14, during the lifting and the lowering of the head plate 12, follows its anatomically correct path, which is denoted 22 in FIGS. 2 and 3.

The head plate 12 is attached to one end of a support shaft 24, which is guided in a manner so it can be shifted between three rollers 26, 28 and 30 in the plane of the drawing. The rollers 26, 28, 30 bear against tracks 32, 34 and 36, respectively, which are formed on the support shaft 24. These tracks 32, 34, 36 are composed of different sections, which are designed as schematically explained in FIG. 2.

FIG. 2 shows a certain position of the head or a time in the adjustment movement of the head at which the center of gravity 18' of the head is at the point on the movement path 22 which is represented in FIG. 2. The associated center of rotation in the vertebral column, that is on path 20" is located at the point denoted $Z_{mom}$. The center of gravity of the head 18 is rigidly connected via the head plate to the support shaft 24 in FIG. 3. The rollers 26, 28, 30 in each case are located at a point 26', 28', 30' on the associated track 32, 34, 36. The points 26', 28', 30' are also points of the support shaft 24, and thus they are rigidly connected to the center of gravity 18 of the head. The four points 18', 26', 28' and 30' can thus only perform a joint movement of rotation about the instantaneous center of rotation $Z_{mom}$ if the instantaneous curvature centers of the tracks 32, 34, 36 coincide with the instantaneous center of rotation $Z_{mom}$, that is the rollers 26, 28, 30 at all times run on concentric sections of a circular path having the center $Z_{mom}$.

Under this condition, when a current or instantaneous center of rotation $Z_{mom}$ is shifted along the paths 20" and 20', the associated sections of the tracks 32, 34, 36 are determined. Joined one after the other, they form the corresponding tracks 32, 34 and 36. The tracks are all different. However, when combined, due to the rolling movement on the corresponding rollers 26, 28 and 30, respectively, they produce the desired movement path of the head plate 12 and thus of the center of gravity 18 of the head.

Figure 6:
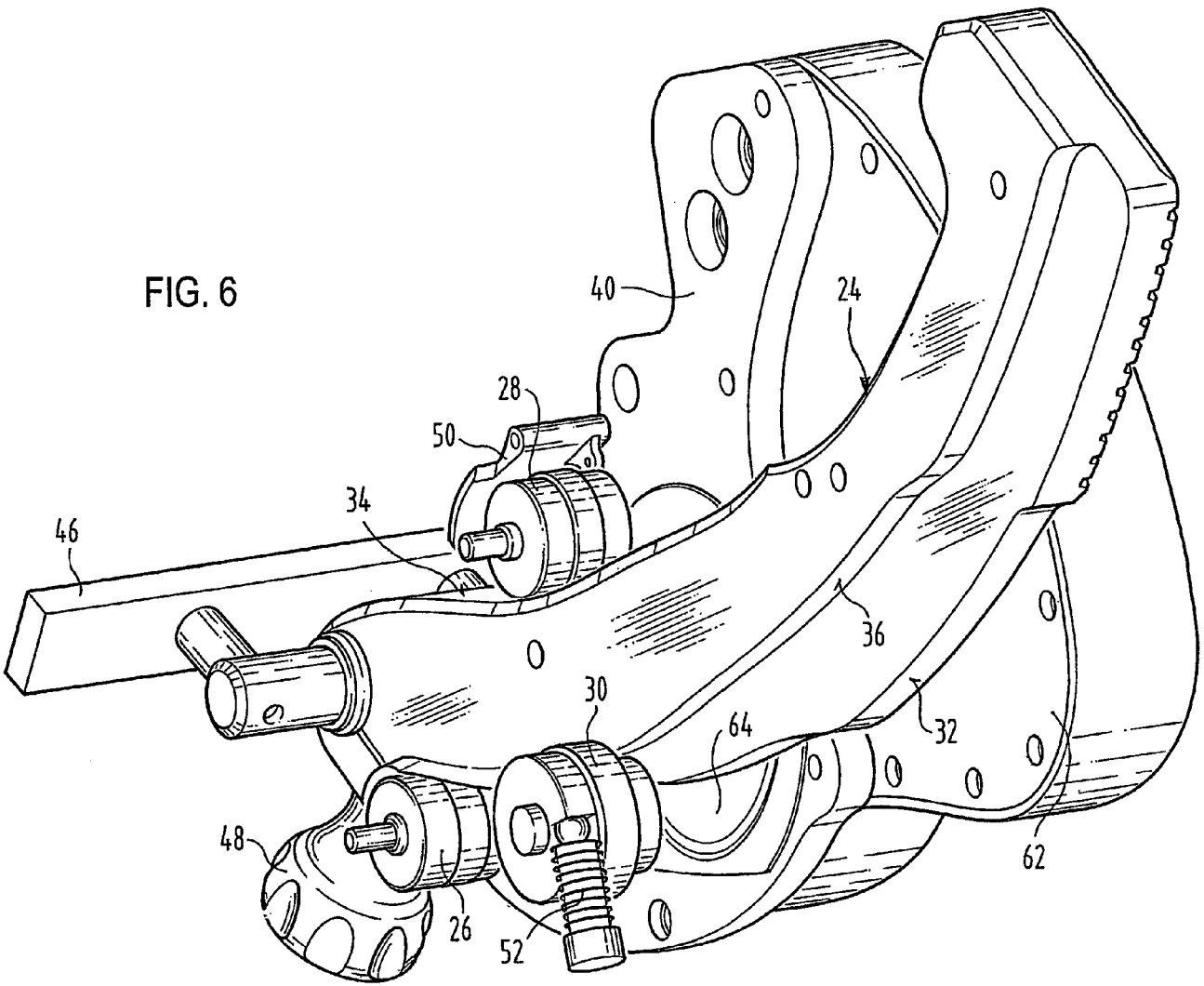
FIG. 6 is a representation corresponding to that of FIG. 5, however viewed from the other side.

FIGS. 4–7 are schematic representations of the technical implementation of the inventive head rest on the basis of a preferred embodiment. In the figures, one can see a housing generally denoted 38, which substantially consists of two parallel plates 40, 42 which are connected to one another by bolts 44 at a distance from one another. Between the plates 40 and 42, the rollers 26, 28 and 30 are rotatably mounted about axes which are perpendicular to the plates 40 and 42 and between which the support shaft 24 is guided. In FIG. 6, one can see the tracks 32, 34 and 36 for the rollers 26, 28 and 30, respectively, which tracks are formed on the support shaft 24. The support shaft 24 carries a ledge 46 at one end, to which ledge the head plate 12, not shown in the FIGS. 4 to 7, can be attached. Further, a handle 48 by means of which the support shaft can be manually moved is attached to this end of the support shaft 24. Above the roller 28, a cover plate 50, which can be seen in FIG. 6, is located and is to prevent objects, in particular a patient's hair, from being grabbed by the roller 28 and pulled into the housing 38.

The support roller 30 is prestressed by a spring 52 in the direction to the track 36.

Figure 7:
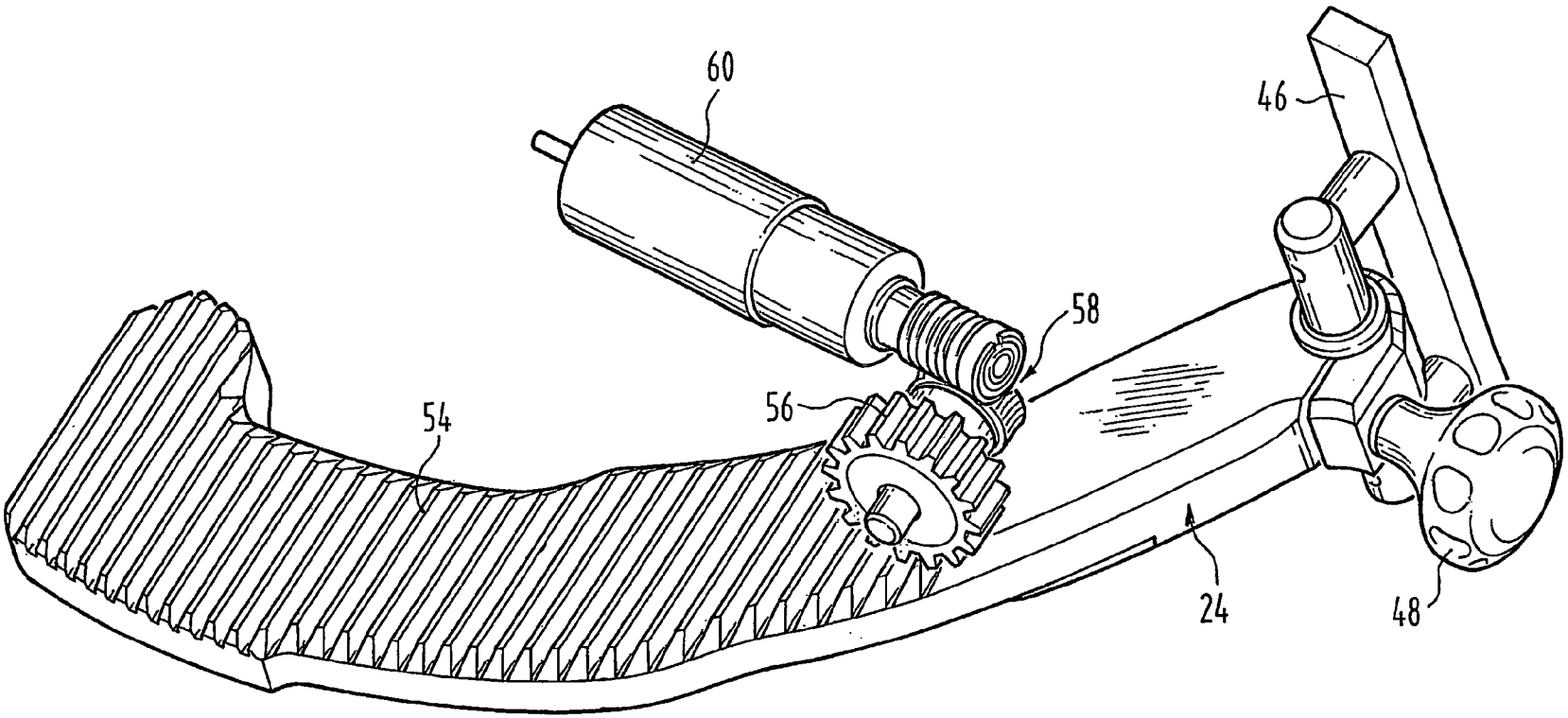
FIG. 7 is a perspective representation of the shaft and the drive device.

The drive for the adjustment of the support shaft 24 is explained in FIG. 7. The support shaft 24 carries on one of its longitudinal sides a gear track 54, into which a pinion 56 engages which is driven via a worm gear drive 58 by a motor 60. The drive device or component which consists of the motor 60, the worm gear drive 58 and the pinion 56, is attached by means of a rotating disk 64 in a manner so it can be pivoted about an axis 66 in a plate 62 which is screwed to the external side of the housing plate 42 so that the pinion 56 can follow the direction of the teeth of the gear track 54 which changes when the support shaft 24 is adjusted. In practice, the drive device is covered by a cover—not shown—which is attached to the plate 62.

The housing 38 can be attached with the help of a support—not shown—on the frame of an operating table or of the patient support surface 10.

The invention claimed is:

1. A motor-adjustable head rest for operating tables, comprising a head plate which is arranged at one end of a curved support shaft having an axis of curvature which is guided in a plane perpendicular with respect to the axis of curvature in a direction of adjustment on a support between three rollers which are spaced from one another in the direction of adjustment and ride in tracks formed on the curved support shaft characterized in that the tracks are shaped such that the instantaneous curvature centers of the tracks coincide with the instantaneous center of rotation $Z_{mom}$ of a patient's head while resting on the head plate.

2. The head rest according to claim 1, comprising at least three tracks, two of which engage a corresponding roller along the lower edge of the support shaft, and one of which engages a corresponding roller along an upper edge of the support shaft.

3. The head rest according to claim 1 or 2, wherein one of the rollers supporting the support shaft is prestressed against the support shaft.

4. The head rest according to claim 1, wherein the support comprises a housing which can be rigidly connected to the operating table, in which the rollers are attached, and the support shaft is led.

5. The head rest according claim 1, characterized in that the support shaft supports a gear track, in which a pinion which can be driven by a motor engages.

6. The head rest according to claim 5, characterized in that the gear track is formed on a side surface of the support shaft which is perpendicular to the axis of curvature of the support shaft, and in that the drive device, comprising the motor and the pinion, is attached to the support in such a manner that it can be moved about a pivoting axle which is perpendicular to the side surface.

7. The head rest according to claim 1, wherein the head plate is driven by a drive device which comprises a threaded spindle which can be rotated by a motor, which rests on the support, and which engages in a nut which is attached in a movable manner to the support shaft.

8. The head rest according to claim 1, wherein the head plate is driven by a drive device which comprises a pulling element, which is attached on, or near, the two ends of the support shaft and which is moved by a drive wheel which can be driven by a motor.

9. The head rest according to claim 1, wherein the head plate is driven by a drive device comprising a hydraulic cylinder which rests on a support.

* * * * *